United States Patent [19]

Aoki et al.

[11] Patent Number: 4,556,035

[45] Date of Patent: Dec. 3, 1985

[54] METHOD AND APPARATUS FOR DETECTING THE IGNITION TIME POINT OF AN ENGINE

[75] Inventors: Keiji Aoki; Shinji Ikeda, both of Susono, Japan

[73] Assignee: Toyota Jidosha Kabushiki Kaisha, Toyota, Japan

[21] Appl. No.: 609,185

[22] Filed: May 11, 1984

[30] Foreign Application Priority Data

May 18, 1983 [JP] Japan ..... 58-87259
May 23, 1983 [JP] Japan ..... 58-90180

[51] Int. Cl.[4] ..... F02P 5/04; F02D 1/06

[52] U.S. Cl. ..... 123/488; 123/494; 123/501; 123/426

[58] Field of Search ..... 123/425, 426, 494, 435, 123/436, 488, 501; 73/116

[56] References Cited

U.S. PATENT DOCUMENTS 4,130,097 12/1978 Ford ..... 123/425
4,369,748 1/1983 Steinke ..... 123/494
4,417,554 11/1983 Dinger ..... 123/501
4,463,729 8/1984 Bullis ..... 123/501

*Primary Examiner*—R. B. Cox
*Attorney, Agent, or Firm*—Finnegan, Henderson, Farabow, Garrett & Dunner

[57] ABSTRACT

A method of detecting the ignition time point of an engine by detecting the ignition of the engine by the detection of the burning flame light of the fuel in the combustion chamber of the engine and by photoelectrically converting the burning flame light thus detected into an electrical signal so as to determine the ignition time point of the fuel, which comprises the steps of: (a) converting the burning flame light detected by the flame sensor into a voltage signal through photoelectric converting means; (b) applying said voltage signal to a comparator and comparing said electrical signal with a reference voltage; (c) varying said reference voltage in accordance with the running conditions of the engine; and (d) detecting the ignition time point from the resulting output signal from said comparator, and an apparatus for the same. With this construction, the ignition time point of the engine can be accurately detected and improvements in the fuel consumption rate as well as the transmission efficiency can be realized thereby.

13 Claims, 8 Drawing Figures

METHOD AND APPARATUS FOR DETECTING THE IGNITION TIME POINT OF AN ENGINE

BACKGROUND OF THE INVENTION (1) Field of the Invention

The present invention relates to method and apparatus for detecting the ignition time point of an engine, more particularly to a method for detecting the ignition or the ignition time point of an engine from the output signal from a flame sensor mounted at the combustion chamber of the engine and an apparatus for the same.

(2) Description of the Prior Art

Recently, in the field of art concerning Diesel engines, there has been proposed a system for detecting the ignition of fuel injected and for precisely controlling the fuel timing and fuel injection amount by a feedback loop in accordance with the fuel ignition state. In such a control system mentioned above, a flame sensor for detecting the ignition state of the fuel is used which is, for instance, shown in FIG. 1 as a flame sensor 1. The flame sensor 1 comprises a cylindrical housing 2 within which a light guide 3 made of a heat-resistant, light-transmissive material such as quartz glass is fitted. The light guide 3 has a detection end 4 which is slightly projected out of the cylindrical housing 2.

As shown in FIG. 2, the flame sensor 1 is mounted in such a manner that the detection end 4 projects inside the combustion chamber 6 of a Diesel engine 5 and the fuel thus injected from a fuel injection nozzle 7 can reach near detection end 4. The burning flame light detected by the flame sensor 1 mounted in the combustion chamber 6 is transmitted through a light transmitting means such as an optical fiber 8 to a photoelectric converting means not shown, such as photodiode, phototransistor or photocell where the burning flame light is converted into an electrical signal i.e. voltage signal as shown in FIG. 3. The combustion state or condition of the fuel in the combustion chamber 6, however, varies dependent to the actual running condition of the engine, i.e. the engine speed, the magnitude of the fuel injection amount, etc.

For instance, if the engine load which corresponds to the ratio between the engine speed and the fuel injection amount is high, the waveform of the voltage signal detected by the ignition sensor or flame sensor becomes large after a photoelectric conversion as shown in FIG. 3 (*a*), while if the engine load is low, the waveform of the voltage signal becomes small as shown in FIG. 3 (*b*). However, the ignition start time point in which the voltage signal rises does not change at all, even if the load is changed as marked by as show the arrow shown in the figure.

The time point of the rise of the signal mentioned above is indicated by the rise of the voltage signal slightly above 0 volt. However, since the signal in the vicinity of 0 volts is superimposed with noise, the threshold level of the detected signal Vt is determined so as to avoid false indication of the voltage signal due to noise. Accordingly, when the waveform (the peak value) of the signal differs from signal to signal as shown in FIG. 3 (*a*) and (*b*), the discrepancy among the signal detecting timing or time point will occur by the time $\Delta t$, thus making the accurate detection of the ignition timing impossible.

SUMMARY OF THE INVENTION

It is therefore an object of the present invention to provide a method of detecting the ignition time point by detecting the threshold level, after the photoelectric conversion, of the signal corresponding to the burning flame light, in which the waveform of the signal changes in accordance with the running conditions of the engine, by controlling the threshold so that, the ignition can be accurately detected, even when the running conditions of the engine change.

It is another object of the present invention to provide a method of detecting the ignition time point of an engine in which the burning flame light is detected by a flame sensor, is then converted into an electrical signal through photoelectric converting means, and is compared with a reference voltage in a comparator so as to change the level of the reference voltage in accordance with the running condition of the engine.

It is still another object of the present invention to provide a method of detecting the ignition time point of an engine in which an accurate detection of the rising edge of the detected signal can be realized by the detection of the burning flame light by a flame sensor and by the photoelectric conversion of the detected light into an electrical signal by a photoelectric converting means as well as by the comparison of the converted electrical signal with a reference voltage level which varies in accordance with the engine load.

It is yet still another object of the present invention to provide an apparatus for detecting the ignition time point of an engine in which the detected and photoelectrically converted electrical signal is compared with a reference voltage, the level of which is changed in accordance with the engine load.

One feature according to the present invention resides in the method which comprises the steps of: detecting the engine speed, the opening of an accelerator, and the burning flame light in the combustion chamber of the engine; calculating an engine load from the engine speed and the opening of the accelerator; determining whether or not the engine load thus calculated is below a predetermined level or value by comparing the engine load with the predetermined value; and varying a reference voltage to be applied to one input of a comparator which compares the detected voltage signal corresponding to the burning flame light of the fuel in the combustion chamber of the engine, in accordance with the result of the determination.

Another feature of the present invention resides in the apparatus for detecting the ignition time point of an engine which comprises: a plurality of sensors including a flame sensor for detecting the burning flame light of the fuel in the combustion chamber of the engine, as well as for detecting the engine speed and the opening of an accelerator; light transmitting means coupled to said flame sensor so as to transmit the burning flame light detected by said sensor; photoelectric converting means for receiving the light transmitted through said light transmitting means and for converting the burning flame light into an electrical signal; a comparator one input terminal of which is coupled to said photoelectric converting means and the other input terminal of which is connected to a reference voltage means, for comparing the converted electrical signal with said reference voltage from said reference voltage means; and an electronic control unit including a CPU, a ROM, and a RAM and for carrying out various operations and calculations in accordance with control programs stored in said ROM and various data including data corresponding to the detected signals through said sensors.

These and other objects, advantages, and features of the present invention will be better understood from the following detailed description with reference to the attached drawings.

DESCRIPTION OF THE PREFERRED EMBODIMENT

Figure 1:
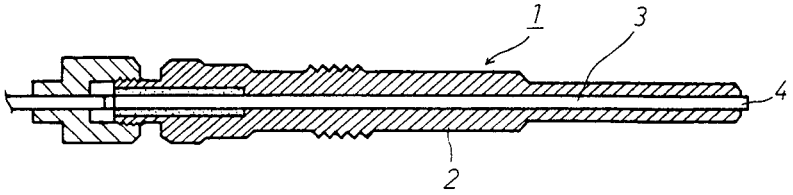
FIG. 1 is a cross-sectional view of a flame sensor for detecting the burning flame light of the fuel in the combustion chamber and to be used in the present invention.
Figure 2:
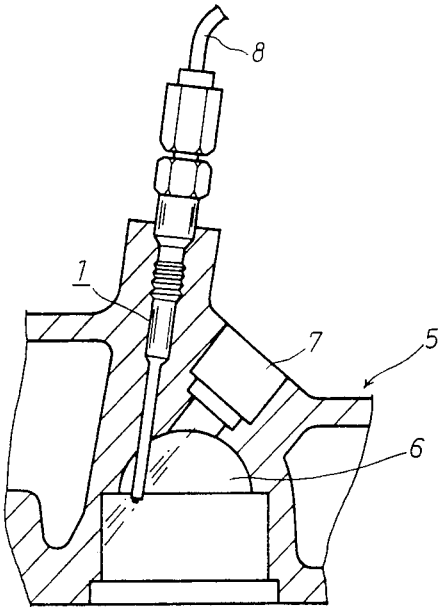
FIG. 2 is a partial cross-sectional view of an engine having a combustion chamber at which the flame sensor shown in FIG. 1 is mounted.
Figure 3:
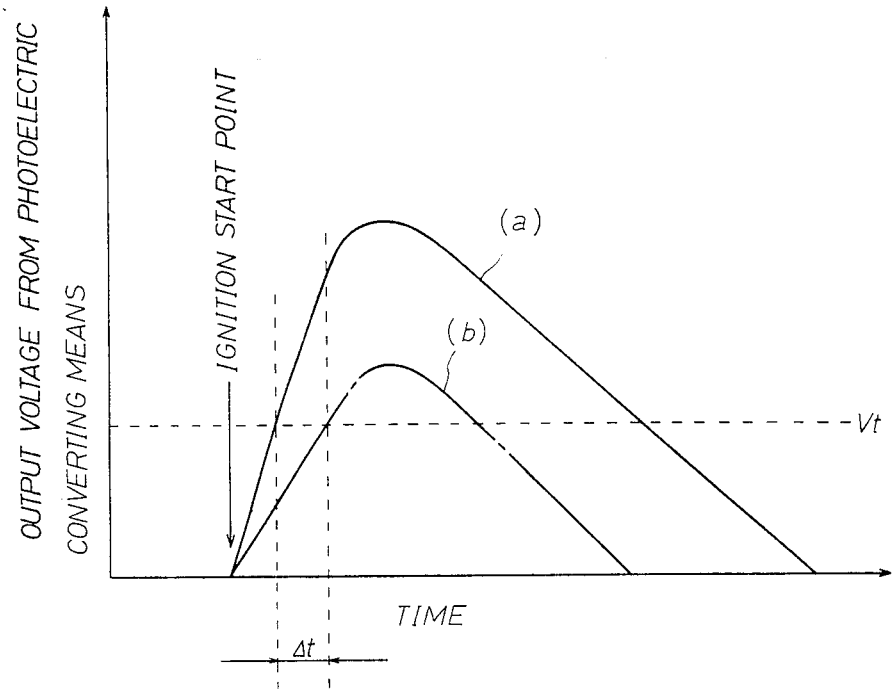
FIG. 3 is waveforms of the output voltage signals detected by the flame sensor shown in FIG. 1 and converted by a photoelectric converting means, according to the prior art.
Figure 4:
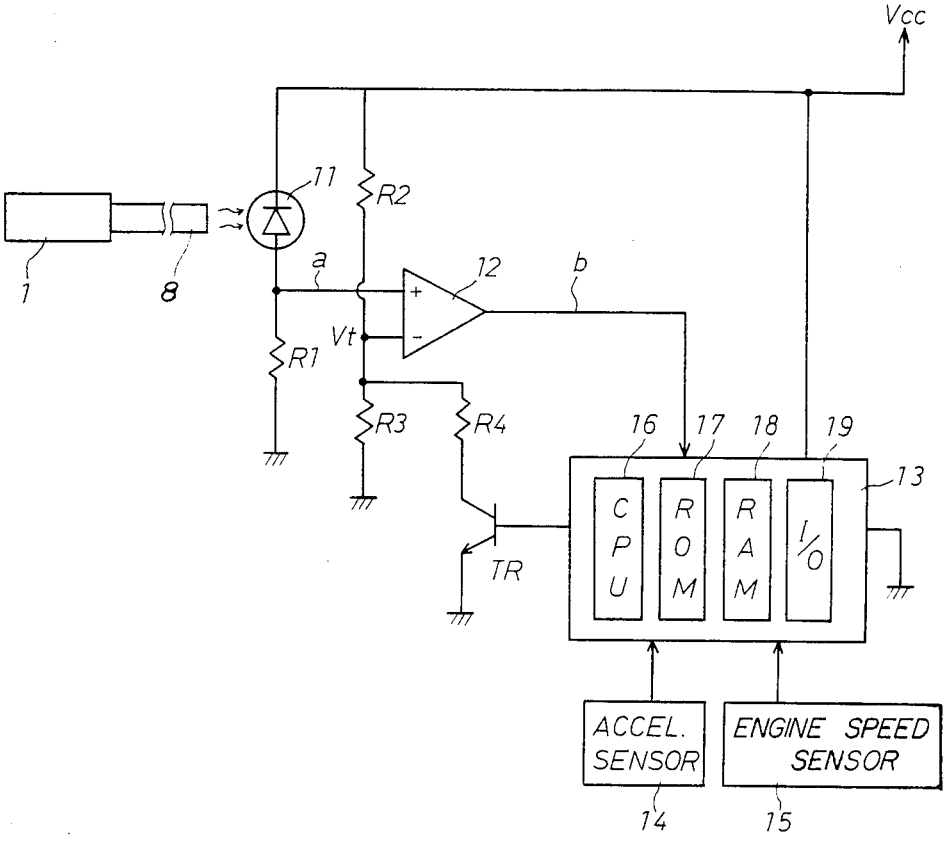
FIG. 4 is the circuit construction of the ignition time point detecting unit including an electronic control unit for realizing the method according to the present invention.

Referring to FIG. 4, the ignition or ignition time point detecting unit according to the present invention is shown, which mainly comprises a flame sensor 1 for detecting the burning flame light in the combustion chamber of an engine, an optical fiber 8 which guide the burning flame light detected by the flame sensor 1 into the detecting unit, an photodiode 11 which converts the burning flame light or the combustion light guided by the optical fiber 8 into an electrical signal, a comparator comprising an operational amplifier 12 for comparing the detected signal with a reference voltage, and an electronic control unit 13. The outputs from an accelerator sensor 14 and from an engine speed sensor 15 are applied to the electronic control unit 13.

In the ignition detecting unit, a constant voltage supply $V_{cc}$ is applied to the cathode of the photodiode 11 and the anode of the diode 11 is grounded to the earth through a resistor R1. Accordingly, the electrical signal converted by the photodiode 11 is picked up from the junction between the photodiode 11 and the resistor R1 and it is applied to the non-inverting input of the operational amplifier 12 as a comparator. On the other hand, to the inverting input terminal of the operational amplifier 12, there is applied a reference voltage from the constant voltage supply $V_{cc}$ which is divided by resistors R2 and R3. The resistor R3 for producing the reference voltage is connected parallel with a resister R4 which in turn connected to the collector of a transistor TR, and the emitter of the transistor TR is grounded to the earth, while the base of the transistor TR is connected to the electronic control unit 13.

The electronic control unit 13 comprises a microprocessor or a central control unit (CPU) 16 for performing various operations and calculations, a ROM (read only memory) 17 in which various control programs and data have been preliminarily stored, a RAM (random access memory) 18 into which data corresponding to the detected signals by various sensors are temporarily stored, and an input/output (I/O) port 19 which interfaces between the components mentioned above. The CPU is controlled in accordance with control programs including various steps of the method according to the present invention.

As described in the foregoing, to the control unit 13 including the CPU 16, the ROM 17 and the RAM 18, there is applied the output signal detected by the accelerator sensor 14, which changes in accordance with the amount of the depression of the accelerator pedal not shown and the output from the engine speed sensor 15 which produces plus signals proportional to the engine speed in synchronization with the rotations of the crank shaft of the engine, not shown. The output of the operational amplifier 12 as a comparator is also applied to the electronic control unit 13.

The ignition detecting unit shown in FIG. 4 including the electronic control unit 13 operates as follows;

First of all, when the burning flame light detected by the flame sensor 1 and transmitted through the optical fiber 8 is converted by photodiode 11 into a voltage signal and the voltage signal is applied to the non-inverting input of the operational amplifier 12 while the reference voltage divided by the resistor R2 and R3 is applied to the inverting input of the amplifier 12. Accordingly, the output from the operational amplifier 12 becomes either high level or low level in accordance with the result of the comparison of the detected voltage signal from the photoelectric of photodiode 11 with the reference voltage and the resulting output from the operational amplifier 12 is applied to the CPU of the control unit 12 so as to accurately detect the ignition time point.

Figure 5:
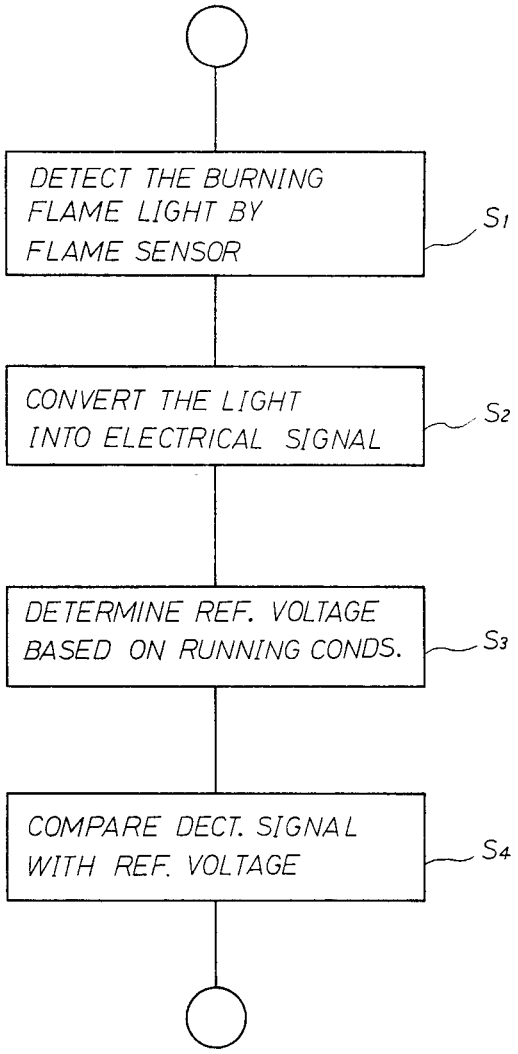
FIG. 5 is principal steps of the method for detecting the ignition time point of the engine according to the present invention.

FIG. 5 shows a brief construction of the method for detecting the ignition time point, according to the present invention which comprises the principal steps of:

($S_1$) detecting the burning flame light by the flame sensor 1;

($S_2$) converting the burning flame light thus detected by the flame sensor 1 into an electronic signal voltage through the photoelectrically converting means such as the photodiode 11;

($S_3$) determining the reference voltage in accordance with the running conditions of the engine; and ($S_4$) comparing the detected signal voltage with the reference voltage through the comparator means 12 and detecting the ignition timing in accordance with the resulting output signal from the comparator means 12.

Figure 6:
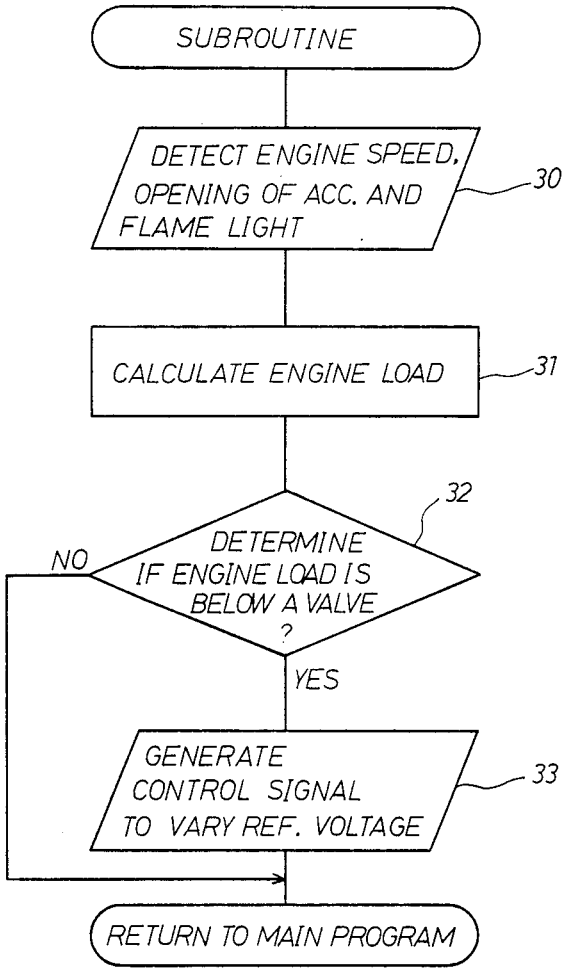
FIG. 6 is a control program flow chart of the method according to the present invention, FIGS. 7(A) and (B) show respectively the wave forms of the detected output voltage signals by the flame sensor after the photoelectric conversion and the output from the comparator shown in FIG. 4, according to the present invention.

FIG. 6 shows one example of a program flow chart for determining the reference voltage to be applied to the inverting input of the operational amplifier or the comparator 12 in accordance with the running conditions of the engine. The data corresponding to this program flow chart has been preliminarily stored in the ROM 17 in the electronic control unit 13 in FIG. 4 as an interrupt subroutine which is to be started during a predetermined time interval.

The operation of the control program will now be made, with reference to the ignition time point detecting unit including the electronic control unit 13 shown in FIG. 4.

When the subroutine shown in FIG. 6 is started, the amount of the opening of the accelerator pedal or the amount of the depression of the pedal is detected by the accelerator sensor 14 and also the engine speed is detected by the engine speed sensor 15 as well as the detection of the burning flame light by the flame sensor 1 in the step 30. The data corresponding to these detected signals are stored into the RAM in the control unit 13 after converting them into digital signals or data through suitable converting means not shown in FIG. 4. and the operation now moves to the next step 31.

In the step 31, an engine load is calculated based on the amount of the opening of the accelerator and the engine speed detected in the previous step 30 and the operation moves to the next step 32.

In the step 32 a decision is made whether or not the engine load thus calculated in the step 31 is below a predetermined value. If the result of the decision or determination is NO, that is the engine load thus calculated is above the predetermined value, the operation of this subroutine returns to a main program without changing the reference voltage to the inverting input of the comparator 12.

However, if the result of the decision is YES, that is, the engine load is below the predetermined value, the operation now moves to the next step 33, where the operation for producing a control signal is performed so as to vary the reference voltage to the comparator 12. Namely, in this case, according to the control circuit shown in FIG. 4, the reference voltage $V_t$ is reduced to the following value;

$$\left(\frac{R3 \cdot R4}{R3 \cdot R4 + R2\,(R3 + R4)}\right) \cdot V_{cc}$$

which is determined by the resistance values of the resistors R2, R3, and R4, when the transistor TR is rendered conductive by the generation of the control signal for changing the reference voltage. This condition is shown by the dotted line $V_t^1$ in FIG. 7(A), showing the relationship between the converted voltage signal after the photoelectric conversion and the time elapsed.

On the other hand, in the foregoing case where the engine load is above the predetermined value, since the control signal for controlling the reference voltage cannot be produced, the transistor TR can no longer rendered conductive, the reference voltage $V_t$ will now become the value shown by the level labelled as $V_t^2$, which is also defined by the ratio of the rasistors R2 and R3; that is $$\left(\frac{R3}{R2 + R3}\right) \cdot V_{cc}$$

Figure 7:
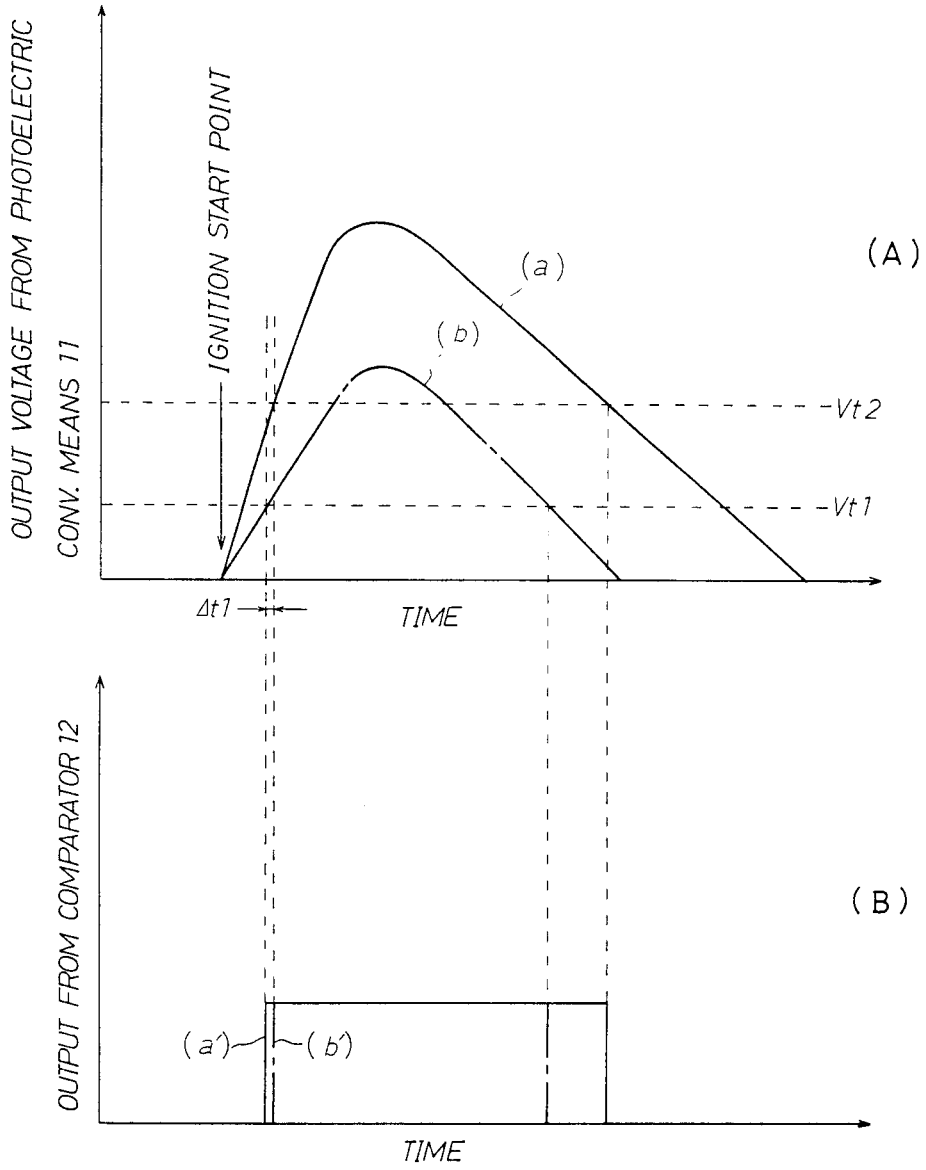

As a result, the discrepancy or difference of the resulting comparative output from the comparator 12 becomes extremely small in the delay time from the actual ignition time point until the time point of detecting the signals, as shown by the amount tl, between the numeral (a') and (b'), even if the engine load is changed as shown in FIG. 7(A), thus enabling the ignition time to be accurately detected, notwithstanding the change in the engine load.

Figure 8:
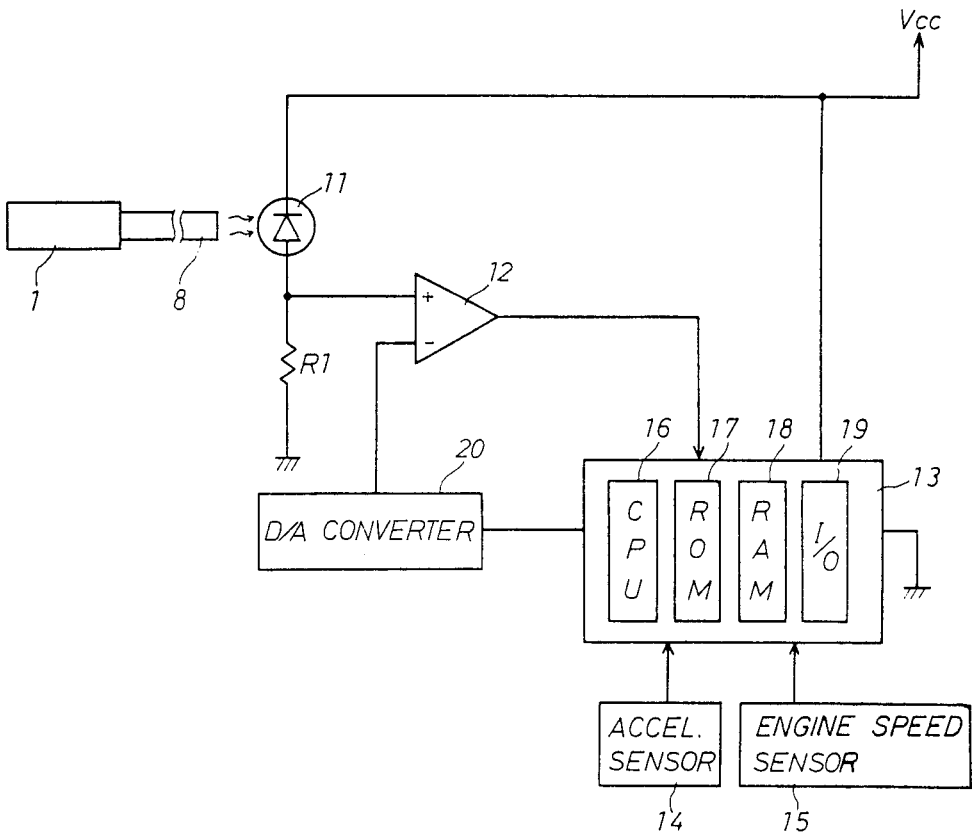
FIG. 8 is another embodiment of the apparatus for detecting the ignition time point according to the present invention, and FIGS. 9(A) and (B) show respectively the waveforms of the detected voltage signals by the flame sensors and converted by the photoelectric converting means and the output from the comparator shown in FIG. 8.

FIG. 8 shows another embodiment of the ignition detecting unit for realizing the method according to the present invention. In the embodiment in FIG. 8, a digital/analog (D/A) converter 20 is provided in the unit, instead of the provision of the voltage divider circuit consisting of the resistors R2, R3, and R4, and the transistor TR between the constant voltage supply $V_{cc}$ and the ground as shown in FIG. 4. Namely, in the control unit shown in FIG. 8, the reference voltage is replaced with the digital data determined by the output signals from the accelerator sensor 14 and from the engine speed sensor 15 and which have been stored in the ROM 17 in the electronic control unit 13 and read therefrom in accordance with the engine load and the digital data corresponding to the reference voltage is converted into an analog signal through the D/A converter 20. The analog signal thus converted is applied to the inverting input of the comparator 12. The remaining circuit components are all almost the same as shown in FIG. 4.

Figure 9:
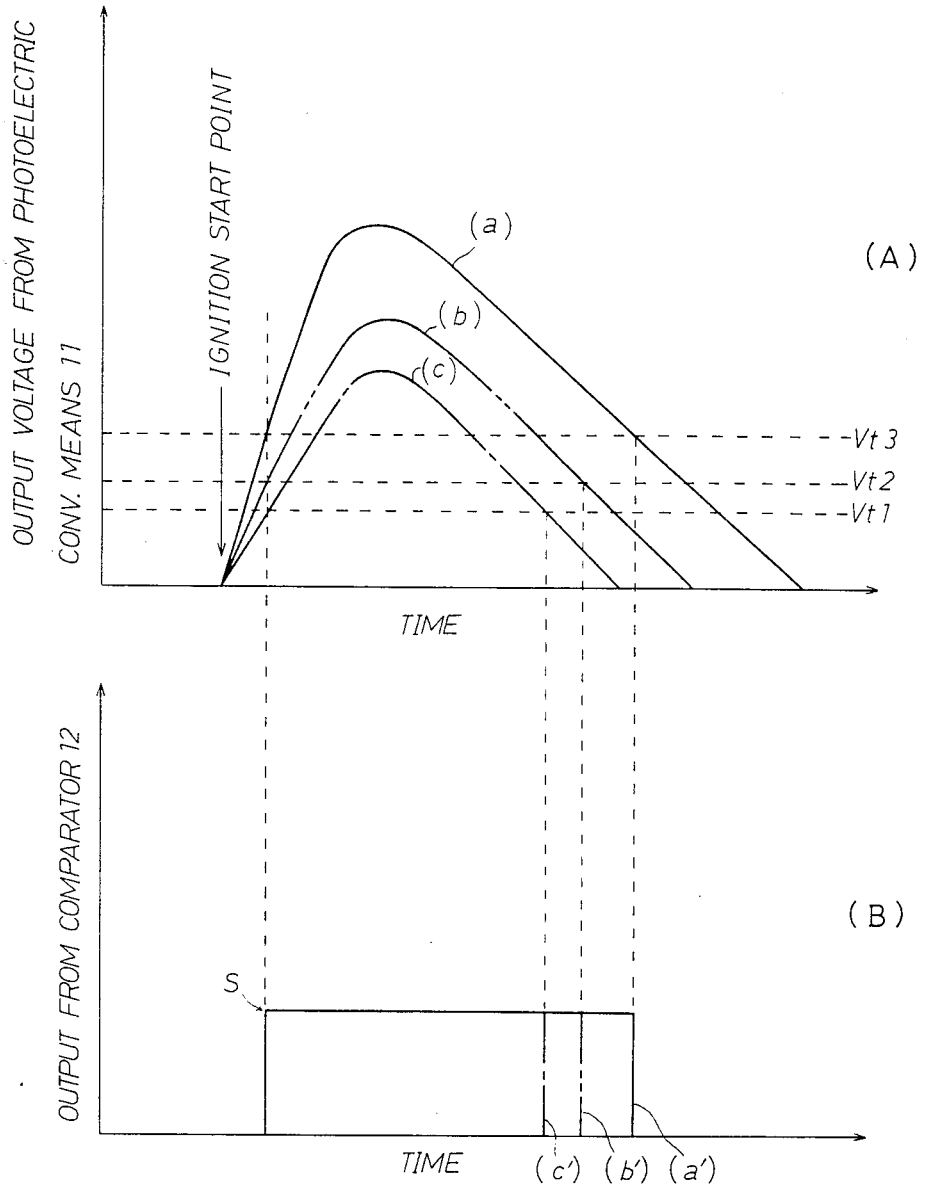

With this construction of the control unit, the converted voltage signal through the photoelectric converting means such as photodiode 11 change each reference voltage as shown by the levels $V_t3$, $V_t2$, and $V_t1$ as shown in FIG. 9 when the waveform thereof changes in accordance with the engine load, so that the output from the comparator 12 becomes same in the riding edges or starts at the same time point S by the reference numerals (a'), (b'), and (c'), even if the voltage signal (a), (b), and (c) changes as shown in FIG. 9(A) after the photoelectric conversion by the converting means change. As a result, the ignition time point, i.e. the ignition start point can be accurately detected in any engine load conditions with no discrepancies occurring due to the different engine loads during the time period from the actual ignition time until the detected time point.

In the second embodiment of the ignition detecting unit according to the present invention, the reference voltage data are calculated in accordance with the engine load, instead of placing the operational step shown in the step 32 in the interrupt subroutine of the control program in FIG. 6 and also the reference voltage data thus calculated in the previous step are outputted to the D/A converter 20 in the second embodiment according to the present invention, instead of producing the reference voltage control signal in the subsequent step 33 in the subroutine in FIG. 6.

As having been described in the foregoing, the method and apparatus for detecting the ignition of an engine according to the present invention are constructed in such a manner that the burning flame light is detected by a flame sensor, it is then converted into an electrical voltage signal through photoelectric converting means and is compared with a reference voltage in a comparator so as to change the level of the reference voltage in accordance with the running conditions of the engine.

Consequently, according to the present invention even when the engine load is changed in accordance with the running conditions of the engine and in turn the waveform of the electrical signal thus detected and photoelectrically converted, and which correspond to the burning flame lights, may be diversely changed, the detection of the ignition time point becomes possible by the accurate detection of the rising edge of the detected signal. As a result, it becomes possible to precisely control the engine by utilizing the accurate ignition time thus detected.

Moreover, since the engine control become more accurate according to the present invention, the secondary effects such as improvement in the transmission efficiency as well as improvement of the fuel consumption rate will be brought about thereby.

While the invention has been described in its preferred embodiments, it is to be understood that the words which have been used are words of description rather than limitation and that various change and modifications may be made within the purview of the appended claims without departing from the true scope and spirit of the invention in its broader aspects.

What is claimed is:

1. A method of detecting the ignition time point of an engine by detecting with a flame sensor the burning flame light of the fuel in the combustion chamber of the engine, which comprises the steps of:

(a) converting the burning flame light detected by the flame sensor into an electrical voltage signal through photoelectric converting means;

(b) applying said voltage signal to a comparator and comparing said voltage signal with a reference voltage;

(c) varying said reference voltage in accordance with the running conditions of the engine; and (d) detecting the ignition time point from the resulting output signal from said comparator.

2. A system of detecting an ignition timing of an internal combustion engine comprising:

(a) means for detecting burning flame light in a combustion chamber of an engine;

(b) means for converting said burning flame light to an electric signal;

(c) means connected to said light detecting means for transmitting said burning flame light to said converting means;

(d) first signal generating means for generating a signal representative of current engine load;

(e) means for comparing said electric signal with a reference signal representing a pre-set voltage level and for producing an output signal representative of said comparison;

(f) means for determining ignition timing based on a said output signal; and (g) means connected to said first signal generating means for changing the value of said reference signal in such a manner that said value of said reference signal in such a manner that said value is increased in accordance with an increase in current engine load, or decreased in accordance with a decrease in current engine load.

3. A method of detecting the ignition time point of an engine, which comprises the steps of:

(a) detecting the engine speed, the position of an accelerator, and the burning flame light of the combustion chamber of the engine;

(b) calculating an engine load from the engine speed and the opening of the accelerator;

(c) determining the ignition time point based on the result of the comparison of a voltage signal corresponding to said burning flame with a reference value; and (d) varying said reference value according to said calculated engine load.

4. A method of detecting the ignition time point of an engine as set forth in claim 3, wherein said reference value is increased according to an increase in said calculated engine load.

5. A method of detecting the ignition time point of an engine as set forth in claim 3 wherein said reference voltage is digital data corresponding to a value determined by the engine load and which has been stored in a memory of a control unit.

6. A system as claimed in claim 2, wherein said first signal generating means comprises:

second signal generating means for generating a signal representative of current engine speed; and means for detecting the position of an accelerator.

7. A system as claimed in claim 2, wherein said comparing means, said determining means, and said changing means comprise a central processing unit, a random access memory, an input/output port, and a ready-only memory containing a control program for operation, calculation, and control.

8. A system as claimed in claim 6, wherein said means for changing the value of said reference signal maintains the value of said reference signal if said current engine load signal is above a predetermined level and decreases said reference signal if said current engine load signal is below said predetermined level.

9. A system as claimed in claim 8, wherein said means for changing said reference signal comprises a transistor and a plurality of resistors connected thereto.

10. A system as claimed in claim 8, wherein said means for changing said reference signal comprises a digital/analog converter.

11. A system as claimed in claim 8, wherein said comprising means generates a high level signal when said electric signal from said converting means is larger than said reference signal, and generates a low level signal when said electric signal from said converting means is less than said reference signal.

12. A system as claimed in claim 2, wherein said transmitting means comprises an element made of optical fiber.

13. A system as claimed in claim 2 wherein said converting means comprises a photodiode, a phototransistor, or a photocell.

* * * * *